US007661664B2

(12) United States Patent
Hume et al.

(10) Patent No.: US 7,661,664 B2
(45) Date of Patent: Feb. 16, 2010

(54) METHOD AND APPARATUS FOR FORMING A DOCUMENT SET

(75) Inventors: Tamas Hume, Fitzroy (AU); Fergus Ramsay, Fitzroy (AU)

(73) Assignee: Envelopments Pty Ltd., Victoria (AU)

( * ) Notice: Subject to any disclaimer, the term of this patent is extended or adjusted under 35 U.S.C. 154(b) by 349 days.

(21) Appl. No.: 10/552,121

(22) PCT Filed: Apr. 7, 2004

(86) PCT No.: PCT/AU2004/000446

§ 371 (c)(1),
(2), (4) Date: Oct. 5, 2005

(87) PCT Pub. No.: WO2004/089646

PCT Pub. Date: Oct. 21, 2004

(65) Prior Publication Data

US 2006/0284360 A1 Dec. 21, 2006

(30) Foreign Application Priority Data

Apr. 7, 2003 (AU) ..... 2003901575

(51) Int. Cl.
*B41F 13/54* (2006.01)

(52) U.S. Cl. ..... 270/1.03; 270/1.02; 53/429; 493/216

(58) Field of Classification Search ..... 270/1.02, 270/1.03, 20.1, 21.1; 53/428, 429, 558, 569; 493/210, 216
See application file for complete search history.

(56) References Cited

U.S. PATENT DOCUMENTS

| | | | | |
|---|---|---|---|---|
| 4,600,141 | A | 7/1986 | Bradley et al. | |
| 5,167,739 | A | 12/1992 | Hutchinson et al. | |
| 6,386,771 | B2 * | 5/2002 | Haller | 400/70 |
| 6,558,054 | B2 | 5/2003 | Haller | |
| 7,236,258 | B2 * | 6/2007 | Wen et al. | 358/1.12 |
| 2003/0041571 | A1 | 3/2003 | Haller et al. | |

FOREIGN PATENT DOCUMENTS

DE 2940771 4/1981

(Continued)

OTHER PUBLICATIONS

Derwent Abstract Accession No. 92-236003/29, FR 2668979 A, (Danel Ferry) May 15, 1992, Abstract.

(Continued)

*Primary Examiner*—Ren Yan
(74) *Attorney, Agent, or Firm*—The Webb Law Firm

(57) ABSTRACT

A method for forming a document set is described. The document set is formed from rectangular sheets of the same size and includes an envelope sheet and at least one insert sheet. The method includes the steps of printing the envelope sheet with envelope information, this envelope information including a unique code identifier, printing each of the insert sheets with insert information, this insert information including a unique code identifier, and further more collating the envelope sheet and the insert sheets to form the document set.

17 Claims, 6 Drawing Sheets

FOREIGN PATENT DOCUMENTS

| | | | |
|---|---|---|---|
| EP | 1091327 | | 4/2001 |
| FR | 2668979 | | 5/1992 |
| GB | 1559606 | | 1/1980 |
| JP | 1160048 | A | 6/1989 |
| JP | 2225098 | A | 9/1990 |
| JP | 4277164 | A | 10/1992 |
| JP | 9216611 | | 8/1997 |
| JP | 10077155 | | 3/1998 |
| WO | 9318925 | | 9/1993 |
| WO | WO 0121416 | | 3/2001 |

OTHER PUBLICATIONS

Derwent Abstract Accession No. 98-245518/22, JP 10077155 A, (Toppan Moore KK) Mar. 24, 1998, Abstract.
Derwent Abstract Accession No. 81-D4546D/16, DE 2940771 A, (Sebald Druck & Verl) Apr. 19, 1981, Abstract.
Derwent Abstract Accession No. 97-466007/43, JP 9216611 A, (Toshiba Seiki KK) Aug. 19, 1997, Abstract.

* cited by examiner

METHOD AND APPARATUS FOR FORMING A DOCUMENT SET

FIELD OF THE INVENTION

The present invention relates to processes for generating bulk mail out items. In a particular form, the present invention relates to forming a document set for further processing into a mail out item.

BACKGROUND OF THE INVENTION

For organisations having a large number of customers to whom accounts or marketing material are mailed, it is clearly impractical to generate this mail manually. Accordingly, the process of printing material pertaining to an individual customer such as billing information and then inserting this printed material into an appropriately addressed envelope has been automated for some time.

Commonly, the insert material will be printed on standard cut sheet such as A4 using high speed industrial digital printers. The insert material is then folded and inserted into standard closed faced envelopes using highly specialised handling equipment. In some instances the envelopes may already be pre-printed with fixed information such as a company logo or a reply paid address. After insertion, the envelope is then printed with the corresponding address related to the personalised information contained in the envelope. These processes are capable of producing between 30 to 100 bulk mail out items per minute.

Clearly at such high processing speeds it is important to be able to have a system for online monitoring. Referring now to FIG. 1, there is shown a typical bulk mail item processing and integrity checking system in detail. Print file 10 containing names, addresses and any other personal information relevant to the mail out is formed from information contained in database 1. This file also contains instructions for generating a unique machine readable code such as a barcode for each sheet of material to be printed. This information is provided 11 to the printer 20 which prints standard cut sheet to form personalised documents 30 that includes a number of insert sheets which are then inserted into envelopes which are fed into the inserter 40 from a separate envelope supply 50.

To provide for online integrity checking of the system a process data file 120 is generated from print file 10. The process data file 120 contains a unique check reference for each printed sheet in addition to the corresponding addressing information. Before insertion into the envelopes the personalised documents 30 are scanned 90 and the machine readable code information is compared with the process data file 120 to verify that the correct documents have been printed. Confirmation of the printing step results in the corresponding address being provided to the envelope printer 60 for printing of the envelope resulting in a completed mail out item 70. This process necessarily assumes that the personalised documents 30 have been inserted 40 correctly into the envelopes. Whilst the envelopes 50 may have fixed information such as logos and reply paid addresses printed on them prior to address printing 60, there is no individual machine readable code which can be used for envelope tracking before the step of address printing 60.

As standard laser printers are often unsuitable for printing multiple layer items such as envelopes, the envelope printer 60 is typically an inkjet printer. Inkjet printers have a number of associated cost and quality issues when compared to laser printers. The mail out item 70 is then provided to the mail system 80. Optionally, an address reader 75 will read the address printed on the envelope so that a record of completed mail out items which are ready to be mailed can be maintained.

There are a number of serious disadvantages with this process. After insertion 40 of the personalised documents 30 into envelopes 50 there is no means to check that this step has been performed correctly before printing 60 of the envelope. If scanning 90 of the code and checking 91 with the process data file 120 has highlighted a problem before insertion then these documents may be out sorted 100 as shown in FIG. 1. However, once the envelope has been printed 60, the only way the process can be audited is by manually sampling 71 the mail out item 70 and scanning the code on the personalised documents 90 and comparing 110 this with the address on the envelope as set out in the process data file 120. If an error is found then the process must be stopped and a number of envelopes and contents must be manually removed to determine the extent of the error and then the process restarted.

Those mail out items which are incorrect must be reprinted and inserted at a later time. As small batches of reruns are inefficient, often a rerun is delayed until a significant number of mail out items require reprocessing. This causes logistical problems as composite lists of errors must be maintained. In addition, if pre-printed envelopes are required for the re-run then these must be re-sourced either from a warehouse store or supplier.

Another disadvantage of this process is that the process data file 120 is generated second hand from the original database 1 via the print file 10. This increases the likelihood of the process data file 120 becoming mismatched to the database 1. In some instances, bulk mail out items may be produced according to the print file 10 but due to a mismatch between this and the process data file 120 there will appear to be errors. Clearly, a process which only requires one master file sourced from a reference database is preferable.

One attempt to address these issues is to use envelopes which contain a transparent window. In this process, the address information is printed onto the inserted material which is folded and oriented to display the address through the window. This negates the requirement to print the address information on the envelope. However, these window envelopes also have a number of disadvantages including increased cost over standard envelopes and a lack of security due to the contents of the envelope being viewable on the occasion where information has been incorrectly inserted into the envelope.

Another significant drawback of window faced envelopes is that consumers associate this type of envelope with bills and therefore these envelopes are not favoured for the delivery of marketing material. In addition, use of window envelopes does not address another serious disadvantage of all of the bulk mailing processes outlined herein which is the expense of procuring and maintaining separate equipment for handling the envelopes and inserted material and also the associated expense with warehousing and auditing of these envelopes.

Accordingly it is an object of the invention to provide a method and apparatus which efficiently reduces the scope for mismatching of envelopes and related contents in bulk mail out processes It is a further object of the invention to provide a method and apparatus which reduces the complexity and variety of types of handling apparatus required in bulk mailing processes.

SUMMARY OF THE INVENTION

In a first aspect the present invention accordingly provides a method for forming a document set, said document set formed from rectangular sheets of the same size and including an envelope sheet and at least one insert sheet, the method including the steps of:

printing said envelope sheet with envelope information, said envelope information including a unique code identifier;

printing each of said at least one insert sheets with insert information, said insert information including a unique code identifier, and collating said envelope sheet and at least one insert sheet to form said document set.

As both the envelope sheet and the at least one insert sheets are of the same size and additionally uniquely identified this greatly simplifies the handling of the document set and furthermore allows for the verification of the document set when processing the document set into a bulk mail out item.

Preferably, the method further includes verifying said document set by reading each of said code identifiers and performing a self-referencing integrity check.

As no comparison is required with a separate verification list or file during the integrity check the whole verification process is greatly simplified.

Preferably, the method further includes out sorting any document set that fails said integrity check.

Those document sets which fail the integrity check can be out sorted for further inspection if required.

Preferably, the method further includes rescheduling the printing of said document set that failed said integrity check.

As it is immediately determined whether a document set has failed the integrity check, a list of these failed documents sets can be generated and the printing of this list easily rescheduled.

Preferably, said step of rescheduling is performed online.

In this manner the failed document set can be simply rescheduled online and reprinted immediately if required.

Preferably, said unique code identifier identifies whether a printed sheet is an envelope sheet.

Preferably, said unique code identifier printed on said envelope sheet includes the number of at least one insert sheets associated with said envelope sheet to form said document set.

By identifying whether an individual sheet is an envelope or an insert sheet and furthermore if it is an envelope sheet then specifying the number of associated insert sheets this greatly improves the self-referencing capability of the verification process.

In a second aspect the present invention accordingly provides a method for forming a document set, said document set formed from rectangular sheets of the same size and including an envelope sheet and at least one insert sheet, the method including the steps of:

applying an adhesive layer to at least one side of said envelope sheet in a predetermined pattern, said pattern arranged to provide adhesive means for an envelope formed from said envelope sheet when said envelope from said envelope sheet is re-used;

printing said envelope sheet with envelope information, said envelope information including a unique code identifier;

printing each of said at least one insert sheets with insert information, said insert information including a unique code identifier, and collating said envelope sheet and at least one insert sheet to form said document set.

In a third aspect the present invention accordingly provides a method for producing a bulk mail out item from the document set formed according to a first or second aspect of the invention, said method including the steps:

separating and folding at least one insert sheet from said document set to form a folded insert sheet set; and wrapping and sealing the envelope sheet about the at least one insert sheet to form an envelope.

In a fourth aspect the present invention accordingly provides a bulk mail out item resulting from the method for producing a bulk mail out item according to a third aspect of the invention.

In a fifth aspect the present invention accordingly provides an apparatus for forming a document set, said document set formed from rectangular sheets of the same size and including an envelope sheet and at least one insert sheet, said apparatus including:

a printer for printing said envelope sheet with envelope information, said envelope information including a unique code identifier and furthermore for printing each of said at least one insert sheets with insert information, said insert information including a unique code identifier, and a collator for collating said envelope sheet and at least one insert sheet to form said document set.

BRIEF DESCRIPTION OF THE DRAWINGS

A preferred embodiment of the present invention will be discussed with reference to the accompanying drawings wherein.

In the following description, like reference characters designate like or corresponding parts throughout the several views of the drawings.

DESCRIPTION OF PREFERRED EMBODIMENT

Figure 2:
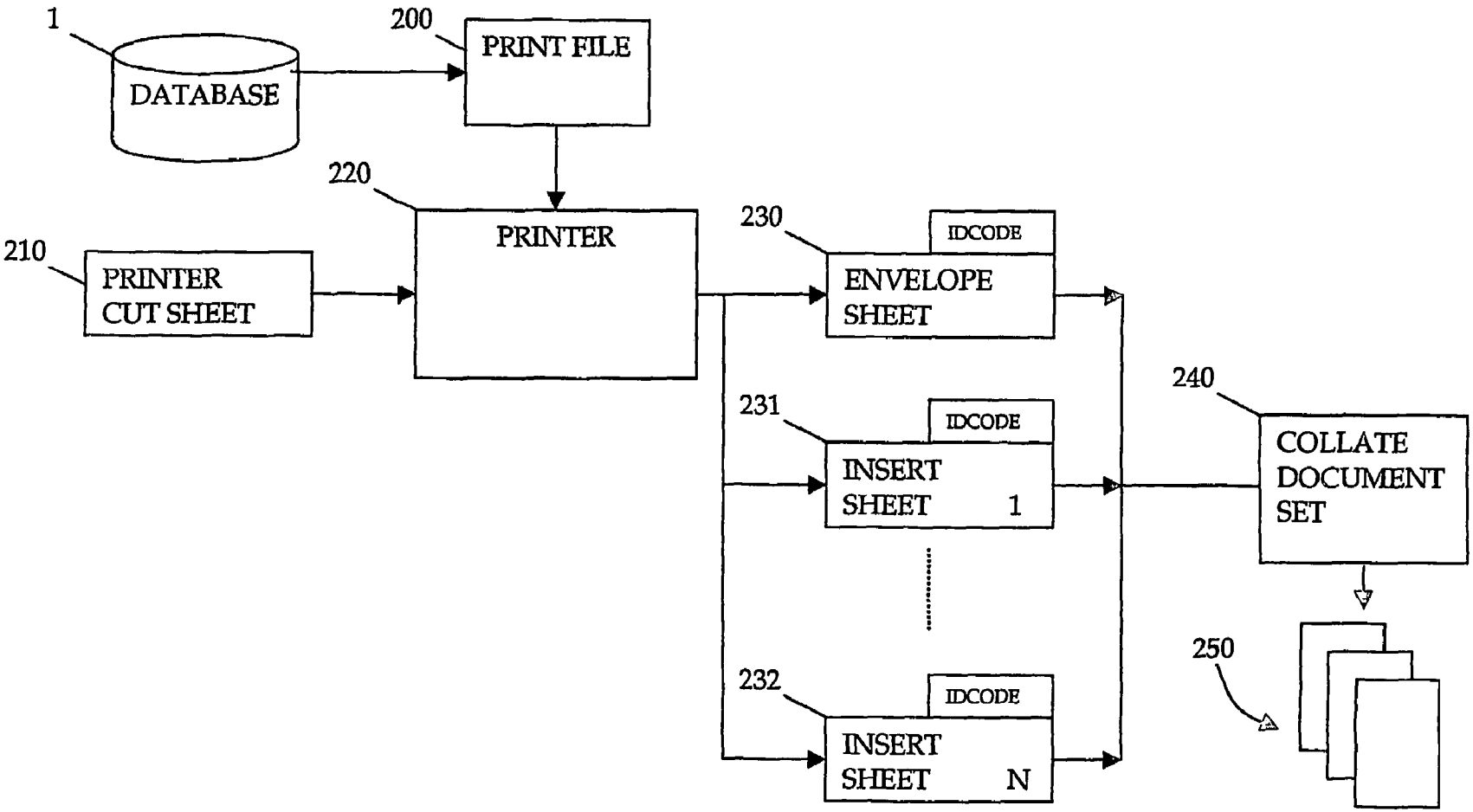
FIG. 2 is a flowchart illustrating a method for forming a document set according to a preferred embodiment of the present invention.

Referring now to FIG. 2, there is shown a flowchart illustrating a method of forming document set according to a preferred embodiment of the present invention. Print file 200 is generated from database 1 and contains all information which is printed on each envelope sheet 230 and associated insert sheets 231, 232. This information will include personalised information relevant to each mail item that is to be formed from each document set 250 such as names, addresses, title to be used etc. As would be appreciated by those skilled in the art, this information will generally be customised according to the requirement of the mail out item which will be formed from the document set 250.

In addition to personalised information such as outlined above, print file 200 will include information which will be used to generate a unique code identifier (generally referred to IDCODE within the description) which will be printed on each of the sheets 230, 231, 232 which form part of document set 250. Cut sheet 210 in the form of single A4 sheets is fed to printer 220 which prints each individual sheet with either envelope or insert sheet information as required and a unique IDCODE for each sheet thereby forming a uniquely identified envelope sheet 230 and at least one uniquely identified insert sheet 231, 232. Individual sheets 230, 231, 232 are then collated 240 to form a document set 250.

Printer 210 in this embodiment is a high speed digital laser printer which will print and collate document sets 250 as a single operation. Alternatively a number of different printers may be used and the sheets collated as a separate step. As all the sheets of paper are of the same size this significantly reduces the complexity of any handling operation. After formation of the document set 250 no further printing is required unlike prior art systems where insert sheets and envelopes are printed at different stages of the process. Clearly, as would be appreciated by those skilled in the art, the invention is applicable to all rectangular cut sheet having the same size.

In another embodiment of the present invention, all of the relevant information including the individual IDCODE may be preprinted onto a continuous roll of paper which has been perforated to form equal size sheets. This continuous roll is then burst along the perforations, in the process forming equal size sheets consisting of a series of envelope sheets and associated insert sheets, each of these sheets containing the relevant personalised information and the unique code identifier IDCODE. Equally, a continuous roll of paper may be cut into equal size rectangular sheets before collation. The individual sheets are then collated to form each of the associated documents sets 250 for further processing. Clearly, as would be apparent to those skilled in the art, the decision of whether information is either printed online by printer 220 or alternatively pre-printed onto either cut sheet or a continuous roll will be determined according to the requirements of the mail out item being formed from document set 250.

Figure 3:
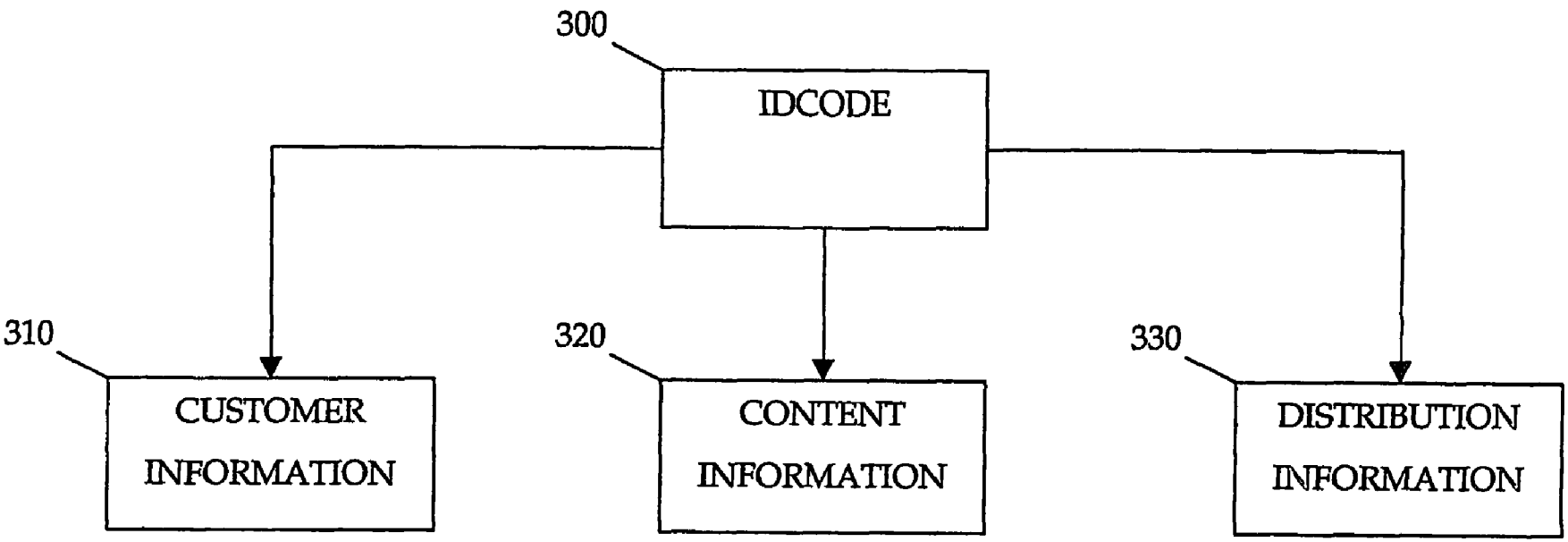
FIG. 3 is a description of the unique code identifier depicting the subsidiary information according to a preferred embodiment of the present invention.

Referring now to FIG. 3, there is shown the types of information incorporated within IDCODE 300 according to preferred embodiment of the present invention. In this preferred embodiment IDCODE 300 will be printed on each sheet in the form of a barcode. IDCODE 300 consists of three types of information relating to customer information 310, content information 320 and distribution information 330.

Customer information 310 in this preferred embodiment consists of a unique sequential number generated from a customer number and an associated license and PIN number. This allows for the tracking and auditing of print jobs for different customers.

Content information 320 includes an indicator of the type of sheet (i.e. envelope or insert) and associated information. For example an individual sheet may be "envelope" sheet n having three associated "insert" sheets and a flag indicating that a separate item such as a credit card should also form part of the document set. As a further integrity check, content information 320 includes an indication of the type and customer information 310 of the item that is to follow in the document set.

Distribution information 330 includes information which can be further used by the postal system to facilitate the sorting of the bulk mail out items for final posting.

Equally other unique code identifying means may be used such as a data matrix or other similar barcode equivalents which can be printed onto each sheet. Another alternative for uniquely identifying each sheet is by using image processing techniques which can recognise combinations of features on both envelope and insert sheets to uniquely identify them. These features could include such items as individual names in combination with their position on an individual sheet.

Figure 4:
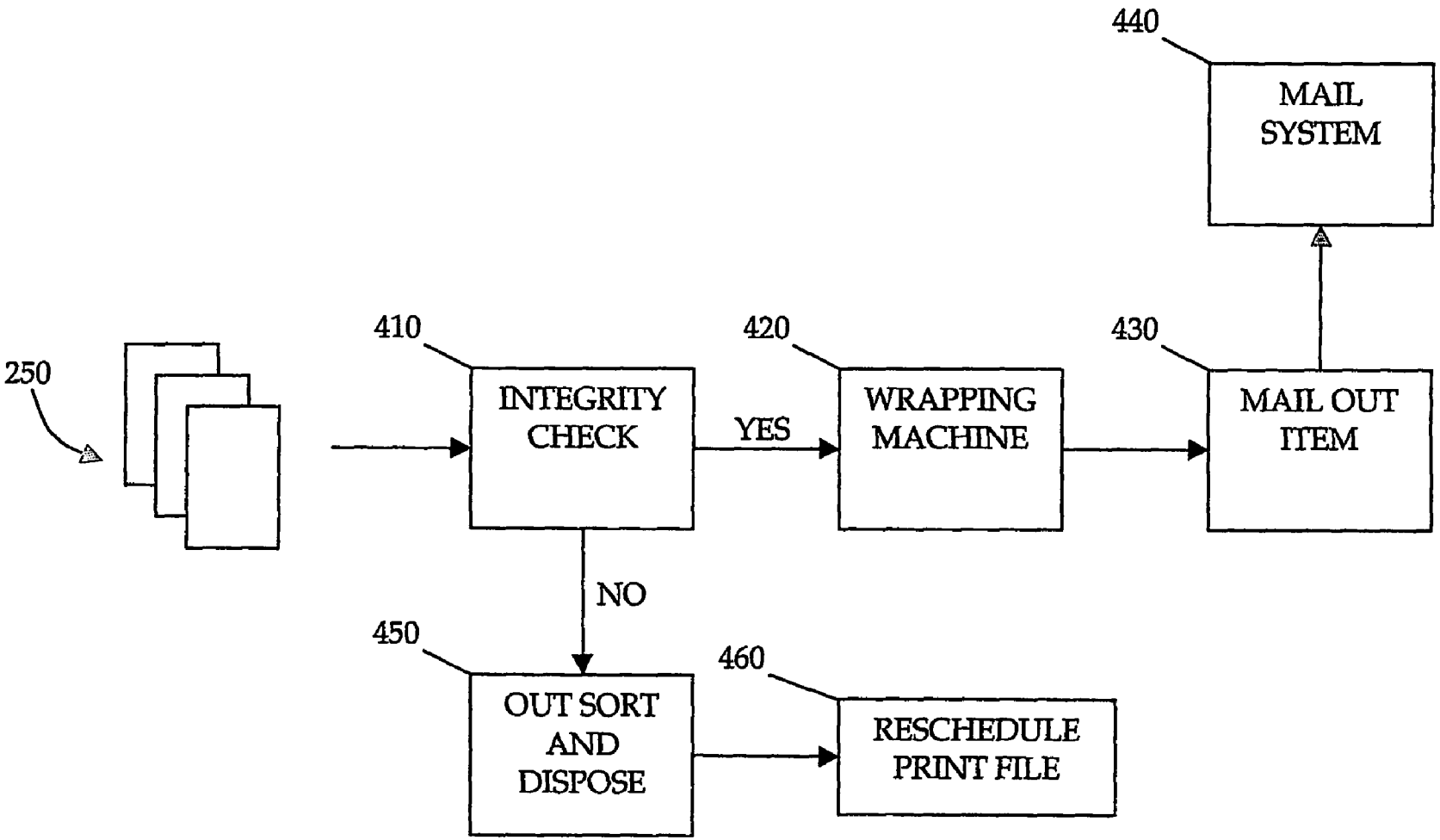
FIG. 4 is a flowchart illustrating a method of producing bulk mail items incorporating the method of forming a document set illustrated in FIG. 1.

Referring now to FIG. 4, there is shown a flowchart of the process which further generates a mail out item 430 based on the document set 250 consisting of an envelope sheet 230 and at least one insert sheet 231, 232 (see FIG. 2). Before document set is wrapped at wrapping machine 420, in the process forming a mail out item 430, an integrity check 410 is performed on document set 250. Based on the content information 320 (see FIG. 3) each document set 250 can be checked to ensure that it consists of an envelope sheet 230 and the correct number of insert sheets 231, 232 as stipulated by the IDCODE 300 printed on the envelope sheet. Further checks ensuring that the order of insert sheets 230, 231 is correct can also be based on the sequential numbering of the customer information 310 section of IDCODE 300. In a further embodiment, a first integrity check 410 is performed on insert sheets 231, 232 and a second integrity check 410 is performed immediately during the wrapping of insert sheets 231, 232 in envelope sheet 230 at the wrapping machine 420 thus checking the consistency of the mail out item 430 just immediately prior to the final formation of the envelope thereby providing a distinct advantage over other prior art systems.

Figure 1:
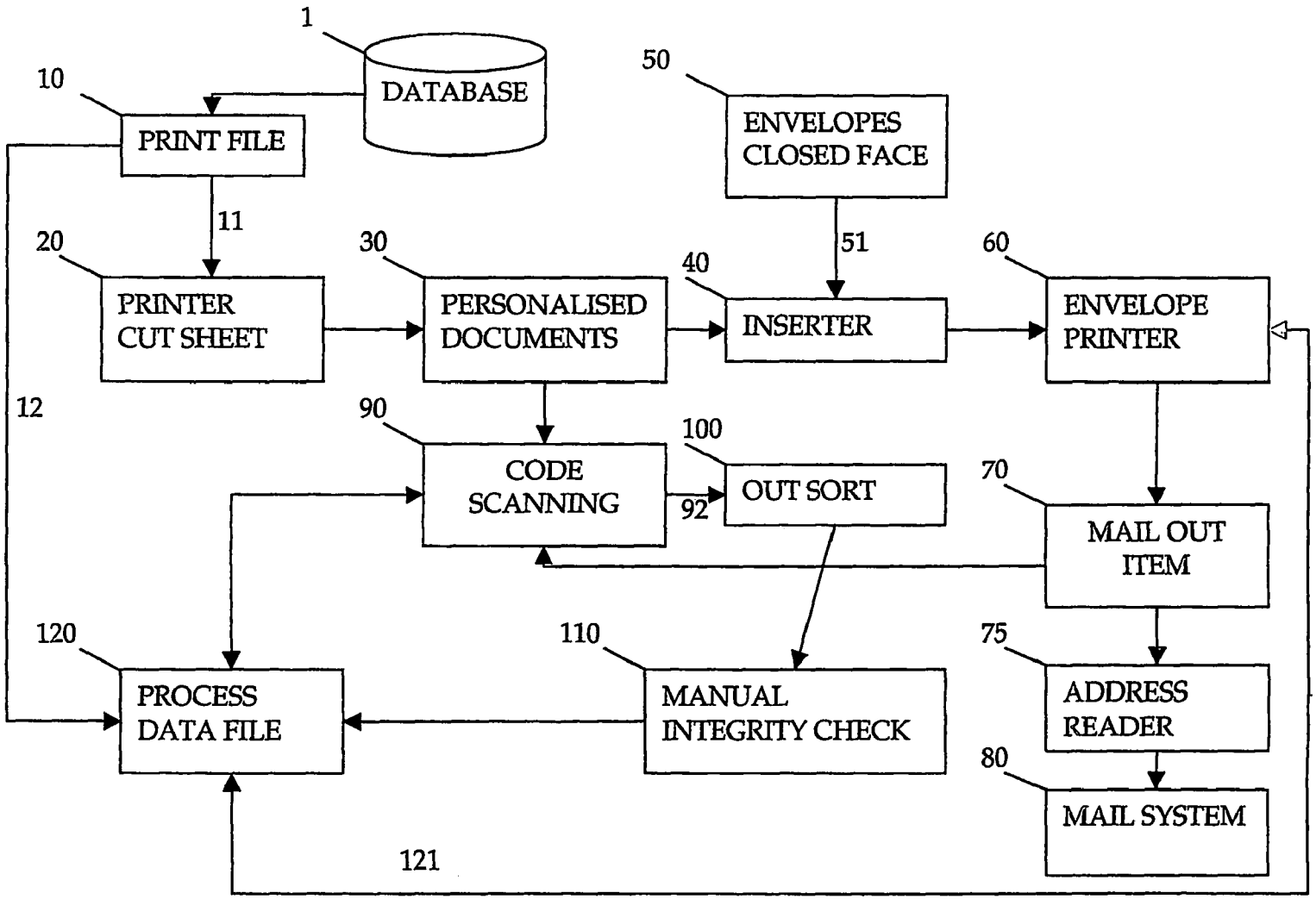
FIG. 1 is a flowchart illustrating one common prior art process for generating bulk mail out items.

It is a feature of the invention that integrity check 410 provides a self referencing consistency check without having to refer to print file 200 or any other similar check file generated from database 1. This greatly simplifies the integrity checking process as can be readily appreciated when comparing FIG. 1 which illustrates a standard system to FIG. 4 which illustrates a system incorporating a document set 250 according to a preferred embodiment of the invention. The mail out item 430 can be further checked by scanning the envelope IDCODE 300 to ensure that the mail out item has been processed and sent to the mail system 440. This is useful in the case where a record of completed mail out items is required for scheduling and auditing purposes.

Those document sets 250 which fail integrity check 410 are immediately out sorted 450 and the paper material can then be recycled. In the preferred embodiment, where document sets 250 are printed online from A4 cut sheet, the print file can be immediately rescheduled 460 to reprint the document set 250 which failed integrity check 410. As problem document sets can be easily identified and removed more efficiently and reliably the accuracy of the entire process is improved. In addition as the formation of document sets is a simple printing and handling operation any incorrect mail out items found can be identified and simply rescheduled at the current batch of processing.

Figure 5:
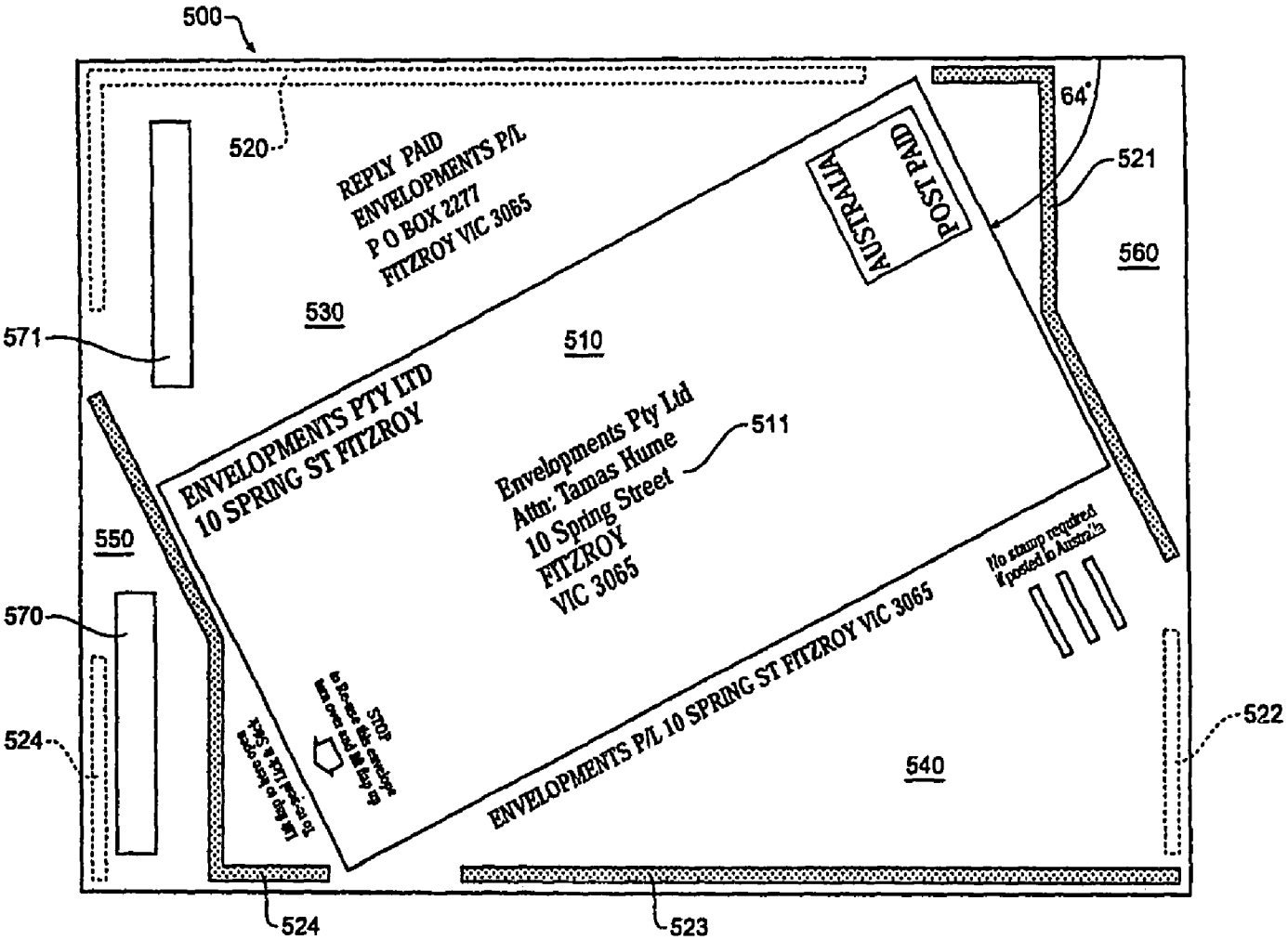
FIG. 5 is an envelope sheet depicting the printed envelope information and also including the position and configuration of glue strips.

Referring now to FIG. 5, there is illustrated an example of a printed envelope sheet 500 suitable for use as a reply paid envelope after processing by wrapping machine 420. Central rectangular area 510, including address 511, makes up the front face of the envelope after wrapping. In this instance a number of glue lines 520, 521, 522, 523, 524 and 525 are included as part of the envelope sheet with glue lines 520, 522 and 525 located on the rear of envelope sheet 500. These can be activated as part of wrapping the envelope in wrapping machine 420 or alternatively a suitable adhesive may be applied as part of the wrapping process.

Top section 530 and bottom section 540 are folded about the insert sheets to form the back face of the envelope. Left section 550 and right section 560 form side flaps of the finished envelope. Flaps 550 and 560 are folded in before flaps 530 and 540. In this embodiment where the envelope is to be used as a reply paid envelope then either flap 550 or 560 are pulled out from 530 and 540 by the recipient of the mail out item, the contents removed then replaced and the open flap then folded over the top of 530 and 540 and sealed by virtue of the strips 570 or 571 of re-wettable glue.

Clearly, as would be apparent to those skilled in the art, the positioning of such a glue strip can be varied according to the type of envelope. In one embodiment the glue strips may be included on customised paper blanks which are to be printed as envelope sheets. As is readily apparent, printing by a digital printer allows sophisticated colour graphics to be printed on the envelope sheet 500 thus removing the requirement to have pre-printed sheet material with all of the associated storage and auditing issues.

Figure 6:
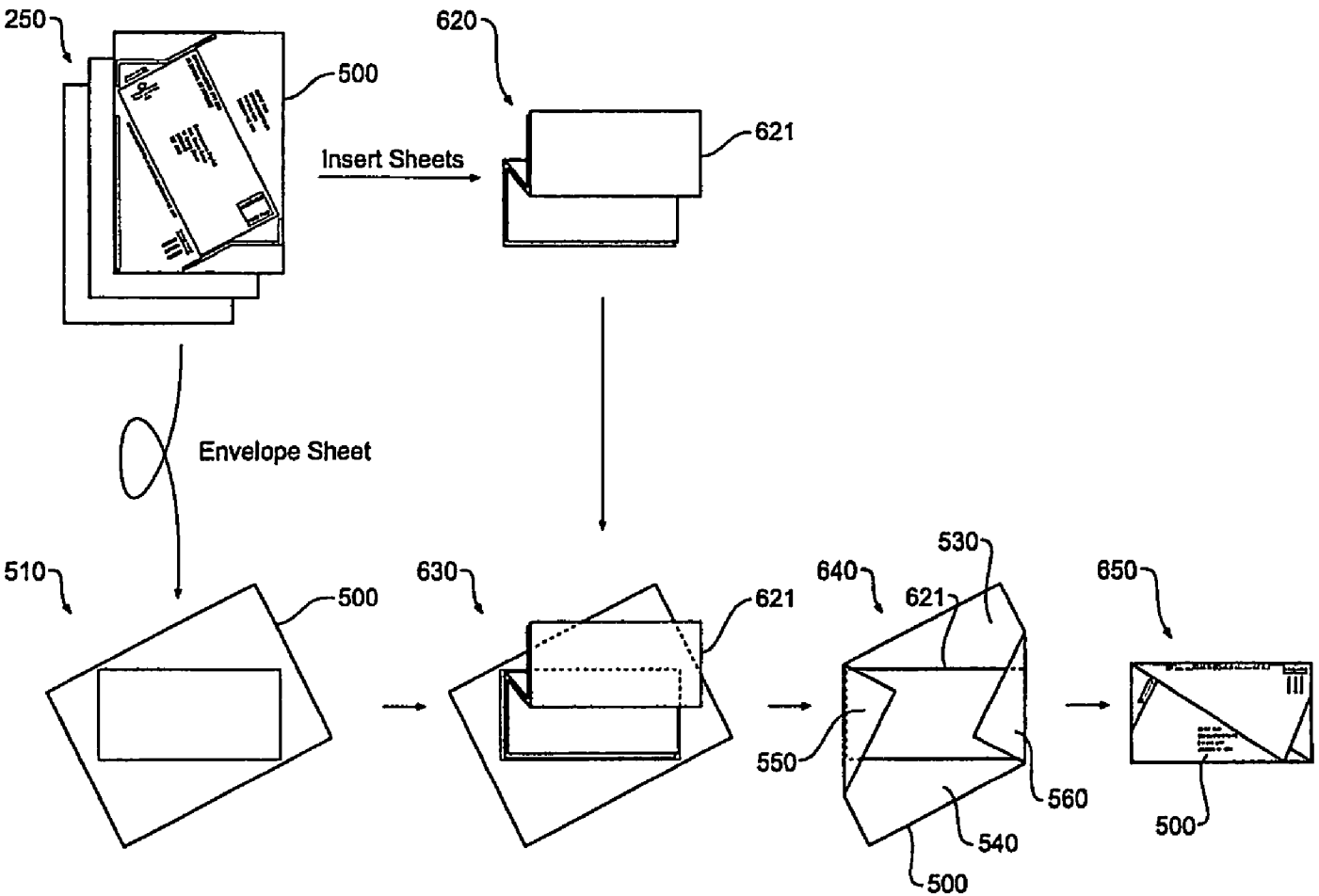
FIG. 6 is a figurative representation of the process of producing a reply paid bulk mail item incorporating the envelope sheet illustrated in FIG. 5.

Referring now to FIG. 6, there is illustrated figuratively a process for forming a reply paid mail out item 650 incorporating the envelope sheet 500 illustrated in FIG. 5. Envelope sheet 500 is first separated from associated insert sheets which are folded 620 into a 'Z' or 'C' type fold to form folded insert sheets 621. Envelope sheet 500 is orientated 610 and folded insert sheets 621 are placed on the opposed side of central rectangular area 510. At this stage other insert material such as credit cards or other such items may be placed on folded insert sheets 621. Once all material has been placed on envelope sheet 500 the bulk mail out item is completed by first folding the end sections 550 and 560 followed by the bottom section 540 and top section 530 thereby forming a completed reply paid mail out item 650.

Although a preferred embodiment of the method and apparatus of the described in the foregoing detailed description, it will be understood that the invention is not limited to the embodiment disclosed, but is capable of numerous rearrangements, modifications and substitutions without departing from the scope of the invention as set forth and defined by the following claims.

The invention claimed is:

1. A method for forming a document set, said document set formed from rectangular sheets of the same size and including only one single envelope sheet and at least one insert sheet, the method including the steps of:

printing said single envelope sheet with envelope information, said envelope information including a unique code identifier to identify said single envelope sheet;

printing each of said at least one insert sheets with insert information, said insert information including a further unique code identifier to identify each of said at least one insert sheets, wherein the unique code identifier of said single envelope sheet is unique from the further unique code identifier of each of said at least one insert sheets;

collating said single envelope sheet and at least one insert sheet by reading the unique code identifier of said single envelope sheet and the further unique code identifier of each of said at least one insert sheets to form said document set; and verifying said document set by performing a self-referencing integrity check on the read unique code identifier of said single envelope sheet and the read further unique code identifier of each of said at least one insert sheets.

2. The method for forming a document set as claimed in claim 1, further including the step of out sorting any document set that fails said integrity check.

3. The method for forming a document set as claimed in claim 2, further including the step of rescheduling the printing of said document set that failed said integrity check.

4. The method for forming a document set as claimed in claim 3, wherein said step of rescheduling is performed online.

5. The method for forming a document set as claimed in claim 1, wherein said unique code identifier identifies whether a printed sheet is said single envelope sheet.

6. The method for forming a document set as claimed in claim 1, wherein said unique code identifier printed on said single envelope sheet includes the number of at least one insert sheets associated with said single envelope sheet to form said document set.

7. The method for forming a document set as claimed in claim 1, wherein said unique code identifier and said further unique code identifier includes separate fields of information related to customer information, content information and distribution information associated with said document set.

8. The method for forming a document set as claimed in claim 1, wherein said unique code identifier and said further unique code identifier are barcodes.

9. The method for forming a document set as claimed in claim 1, wherein the steps of printing the single envelope sheet, printing the at least one insert sheet and collating the single envelope sheet and at least one insert sheet are accomplished using a common printer.

10. The method for forming a document set as claimed in claim 1, wherein said envelope information is printed on one side of said single envelope sheet.

11. A method for producing a bulk mail out item from the document set made in accordance with claim 1, said method including the steps:

separating and folding at least one insert sheet from said document set to form a folded insert sheet set; and wrapping and sealing the single envelope sheet about the at least one insert sheet to form an envelope.

12. A method for forming a document set, said document set formed from rectangular sheets of the same size and including only one single envelope sheet and at least one insert sheet, the method including the steps of:

applying an adhesive layer to at least one side of said single envelope sheet in a predetermined pattern, said pattern arranged to provide adhesive means for an envelope formed from said single envelope sheet when said envelope from said single envelope sheet is re-used;

printing said single envelope sheet with envelope information, said envelope information including a unique code identifier to identify said single envelope sheet;

printing each of said at least one insert sheets with insert information, said insert information including a further unique code identifier to identify each of said at least one insert sheets, wherein the unique code identifier of said single envelope sheet is unique from the further unique code identifier of each of said at least one insert sheets;

collating said envelope sheet and at least one insert sheet by reading the unique code identifier of said single envelope sheet and the further unique code identifier of each of said at least one insert sheets to form said document set; and verifying said document set by performing a self-referencing integrity check on the read unique code identifier of said single envelope sheet and the read further unique code identifier of each of said at least one insert sheets.

13. A method for producing a bulk mail out item from the document set made in accordance with claim 12, said method including the steps:

separating and folding at least one insert sheet from said document set to form a folded insert sheet set; and wrapping and sealing the single envelope sheet about the at least one insert sheet to form an envelope.

14. An apparatus for forming a document set, said document set formed from rectangular sheets of the same size and including only one single envelope sheet and at least one insert sheet, said apparatus including:

a printer for printing said single envelope sheet with envelope information, said envelope information including a unique code identifier to identify said single envelope sheet and furthermore for printing each of said at least one insert sheets with insert information, said insert information including a further unique code identifier to identify each of said at least one insert sheets, wherein the unique code identifier of said single envelope sheet is unique from the further unique code identifier of each of said at least one insert sheets;

a scanner for scanning the unique code identifier of said single envelope sheet and the further unique code identifier of each of said at least one insert sheets;

a collator for collating said envelope sheet and at least one insert sheet in accordance with the scanned unique code identifier of said single envelope sheet and the scanned further unique code identifier of each of said at least one insert sheets to form said document set; and a data processor to process said scanned unique code identifier and said scanned further unique code identifier of each of said at least one insert sheets and perform a self-referencing integrity check, thereby verifying the document set.

15. The apparatus for forming a document set as claimed in claim 14, further including an out sorter for out sorting any document set that fails said integrity check.

16. The apparatus for forming a document set as claimed in claim 15, further including a data processor for rescheduling the printing of said document set that failed said integrity check.

17. The apparatus for forming a document set as claimed in claim 16, wherein said rescheduling is performed online and said document set is printed on said printer.

* * * * *

UNITED STATES PATENT AND TRADEMARK OFFICE

CERTIFICATE OF CORRECTION

PATENT NO. : 7,661,664 B2
APPLICATION NO. : 10/552121
DATED : February 16, 2010
INVENTOR(S) : Hume et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 433 days.

Signed and Sealed this

Thirtieth Day of November, 2010

David J. Kappos

David J. Kappos
*Director of the United States Patent and Trademark Office*